US009670026B2

(12) United States Patent
Watanabe et al.

(10) Patent No.: US 9,670,026 B2
(45) Date of Patent: Jun. 6, 2017

(54) READING APPARATUS AND RECORDING APPARATUS

(71) Applicant: CANON KABUSHIKI KAISHA, Tokyo (JP)

(72) Inventors: Hikaru Watanabe, Tokyo (JP); Masahiro Kawanishi, Yokohama (JP); Takashi Awai, Chiba (JP); Toshihide Wada, Yokohama (JP); Makoto Takemura, Tokyo (JP); Haruo Ishizuka, Ichikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/056,812

(22) Filed: Feb. 29, 2016

(65) Prior Publication Data

US 2016/0257517 A1 Sep. 8, 2016

(30) Foreign Application Priority Data

Mar. 5, 2015 (JP) ..... 2015-044057

(51) Int. Cl.

| | |
|---|---|
| ***B65H 1/12*** | (2006.01) |
| ***B65H 29/50*** | (2006.01) |
| ***B65H 5/06*** | (2006.01) |
| ***B65H 29/14*** | (2006.01) |
| ***B65H 31/02*** | (2006.01) |

(52) U.S. Cl.

CPC ..... *B65H 29/50* (2013.01); *B65H 1/12* (2013.01); *B65H 5/062* (2013.01); *B65H 29/14* (2013.01); *B65H 31/02* (2013.01); *B65H 2301/4212* (2013.01); *B65H 2402/31* (2013.01); *B65H 2404/1421* (2013.01); *B65H 2404/1521* (2013.01); *B65H 2404/6112* (2013.01); *B65H 2404/63* (2013.01); *B65H 2405/1134* (2013.01); *B65H 2405/1136* (2013.01);

(Continued)

(58) Field of Classification Search

CPC ... B65H 1/12; B65H 1/14; B65H 1/04; B65H 2405/3321; B65H 2405/1134; B65H 2405/1136; B65H 2405/11162

See application file for complete search history.

(56) References Cited

U.S. PATENT DOCUMENTS

| | | | | |
|---|---|---|---|---|
| 8,016,283 | B2 * | 9/2011 | Ueda | B65H 3/0607 271/117 |
| 8,104,760 | B2 * | 1/2012 | Hamasaki | B65H 1/04 271/3.14 |
| 8,587,848 | B2 * | 11/2013 | Nose | B65H 3/5223 358/474 |

FOREIGN PATENT DOCUMENTS

| | | | |
|---|---|---|---|
| JP | H10167545 | A | 6/1998 |
| JP | 2001106347 | A | 4/2001 |
| JP | 2005008283 | A | 1/2005 |

* cited by examiner

*Primary Examiner* — Luis A Gonzalez

(74) *Attorney, Agent, or Firm* — Canon U.S.A., Inc. IP Division

(57) ABSTRACT

A reading apparatus includes a reading unit configured to read a document, a feeding tray on which the document to be read by the reading unit is stacked, a feeding roller that feeds the document from the feeding tray to a position where the document is read by the reading unit, a feeding pressure plate that presses the document against the feeding roller so that the document is pinched between the feeding roller and the feeding pressure plate, and a discharge roller that discharges the document read by the reading unit to underneath the feeding pressure plate, wherein a position of the discharge roller moves depending on a number of documents (Continued)

pinched between the feeding roller and the feeding pressure plate.

9 Claims, 9 Drawing Sheets

(52) U.S. Cl.
CPC ..... *B65H 2405/11162* (2013.01); *B65H 2405/3321* (2013.01); *B65H 2801/39* (2013.01)

READING APPARATUS AND RECORDING APPARATUS

BACKGROUND OF THE INVENTION

Field of the Invention

The present invention relates to a reading apparatus and a recording apparatus.

Description of the Related Art

Japanese Patent Application Laid-Open No. 2005-8283 discusses an apparatus including an elevating unit that raises and lowers a sheet feeding tray, including a gear, a rack, and a motor, and an elevation control unit that controls the rise and fall of the sheet feeding tray using an optical sensor. According to the apparatus discussed in Japanese Patent Application Laid-Open No. 2005-8283, a stacking capacity on a sheet discharge tray can be increased as the number of documents on the sheet feeding tray decreases. Therefore, the apparatus can feed a large amount of documents while the apparatus is reduced in space.

However, in the apparatus discussed in Japanese Patent Application Laid-Open No. 2005-8283, the height of the stacked documents is detected using the optical sensor, and the rise and fall of the sheet feeding tray is controlled based on a detection result. Therefore, the optical sensor may react only if the thickness of the stacked documents is changed to some extent, so that the decrease in the number of the documents on the sheet feeding tray and the rise of the sheet feeding tray and a sheet discharge unit (sheet discharge roller) are not interlocked with each other. Accordingly, the height of the sheet discharge unit needs to be determined while allowing for a period elapsed until the optical sensor detects the change in the thickness of the stacked documents, which has been disadvantageous to reduce the height of the apparatus.

Further, even if a sheet feeding and discharge unit is reduced in space, use of mechanism components such as a gear and a rack for an elevating device results in a complicated structure. Therefore, it may be difficult to reduce the size of the apparatus. To provide the elevating device, a control error of the elevating device and a clearance of an operation unit need to be considered, which has been disadvantageous to reduce the height of the apparatus.

SUMMARY OF THE INVENTION

The present invention is directed to a reading apparatus and a recording apparatus the respective heights of which can be reduced without reducing the number of documents that can be fed, with a simple configuration.

According to an aspect of the present invention, a reading apparatus includes a reading unit configured to read a document, a feeding tray on which the document to be read by the reading unit is stacked, a feeding roller that feeds the document from the feeding tray to a position where the document is read by the reading unit, a feeding pressure plate that presses the document against the feeding roller so that the document is pinched between the feeding roller and the feeding pressure plate, and a discharge roller that discharges the document read by the reading unit to underneath the feeding pressure plate, wherein a position of the discharge roller moves depending on a number of documents pinched between the feeding roller and the feeding pressure plate.

Further features of the present invention will become apparent from the following description of exemplary embodiments with reference to the attached drawings.

DESCRIPTION OF THE EMBODIMENTS

An exemplary embodiment of the present invention will be specifically described below with reference to the drawings.

The present invention is applicable to not only a reading apparatus (document reading apparatus) that includes an automatic document feeder (ADF) and reads a document using an image sensor (reading unit) but also a recording apparatus having a recording function of recording an image together with a reading function. Examples of the recording apparatus include a multifunction apparatus (multifunction peripheral) also having other functions such as a facsimile (FAX) function in addition to a printing function (recording function). Further, the present invention is also applicable to a recording apparatus having a recording function of recording an image on a recording medium instead of a reading function. In that case, not a document but a recording medium on which an image is to be recorded is stacked on a feeding tray, a recording unit is provided instead of a reading unit in a conveyance path, and the image is recorded by the recording unit on the conveyed recording medium.

A reading apparatus according to the exemplary embodiment of the present invention will be specifically described.

Figure 1A:
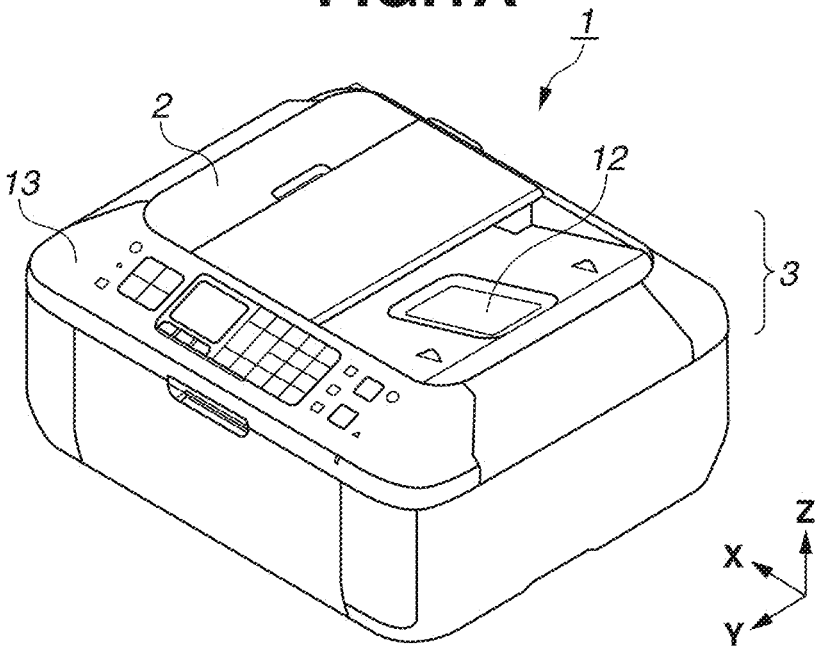
FIGS. 1A and 1B are respectively perspective views illustrating an appearance of a document reading apparatus according to an exemplary embodiment of the present invention.
Figure 1B:
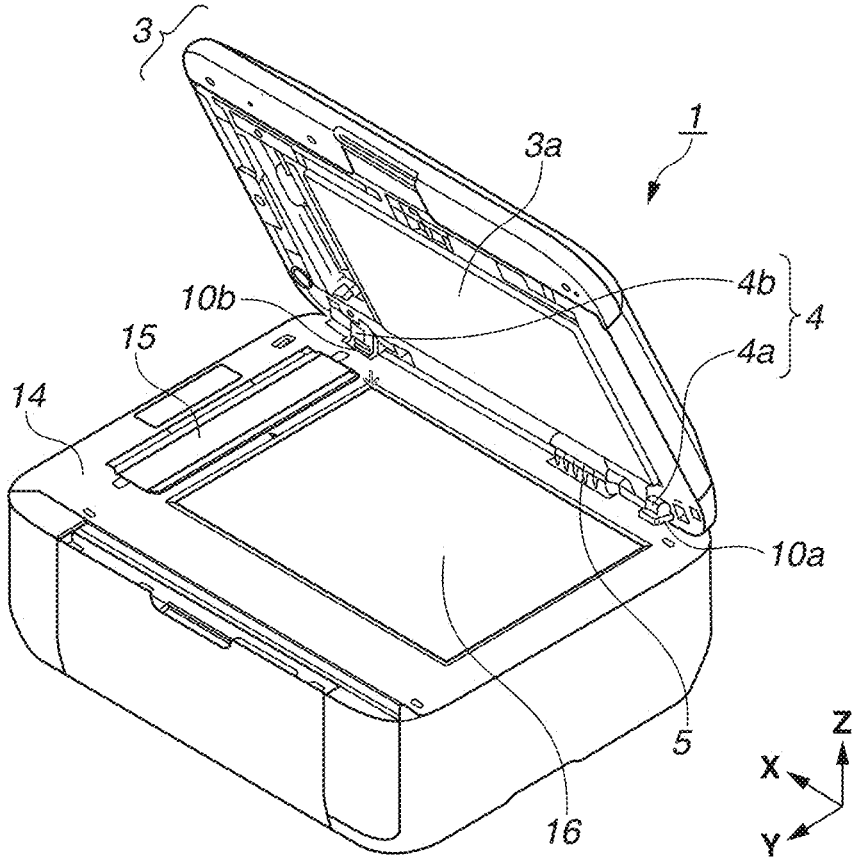

FIGS. 1A and 1B are respectively perspective views illustrating an appearance of a reading apparatus (recording apparatus) 1 according to the exemplary embodiment of the present invention. The reading apparatus 1 includes a document platen unit 14 provided with an image sensor (reading unit) that reads a document, and an ADF 3 that is opened and closed with a hinge 4 with respect to the document platen unit 14. FIG. 1A illustrates a state where the ADF 3 is closed with respect to the document platen unit 14, and FIG. 1B illustrates a state where the ADF 3 is opened with respect to the document platen unit 14. A flatbed scanner (FBS) and a recording unit that records an image of a read document on a sheet (recording medium) are provided under the document platen unit 14. The reading apparatus 1 according to the present exemplary embodiment can perform an operation for reading the document with any of a sheet-through scanner using the ADF 3 and a flatbed scanner.

An operation panel 13 serving as a user interface having an indicator and an input unit arranged on a front side of the operation panel 13 is provided on an upper surface of the ADF 3. A main part of the ADF 3 is a feeding unit 2 that feeds documents one by one to a reading position of the scanner. The feeding unit 2 and a discharge tray 12 are provided on a base 3*a* which is a housing of the ADF 3. The ADF 3 is attached to the document platen unit 14 to be operable and closable with respect to the document platen unit 14 with the hinge 4 including a hinge 4*a* and a hinge 4*b* provided at two positions on a back side of the document platen unit 14 in the reading apparatus 1. A user manually performs an opening and closing operation on a front side of the reading apparatus 1.

Each of the two hinges 4*a* and 4*b* has a rotation axis and a damper mechanism. Axial directions of the two rotational axes are the same direction (X-direction). One component of each of the hinges 4*a* and 4*b* is fixed to the base 3*a*, and the other component of each of the hinges 4*a* and 4*b* is fixed to the document platen unit 14. More specifically, the other components of the hinges 4*a* and 4*b* are respectively inserted to be slidable up and down into recessed portions 10*a* and 10*b* formed in a base 24 (see FIG. 2) which is a housing of the flatbed scanner and are fixed thereto. Thus, a thick document can be reliably pressed.

A hole 5 through which an electric cable is to be passed is provided on the base 3*a* of the ADF 3 and an upper surface of the document platen unit 14, between the hinges 4*a* and 4*b*. The electric cable including a flexible flat cable (FFC) connected to electric components such as a motor and an encoder sensor provided in the feeding unit 2 in the ADF 3 is wired via the hole 5, and is connected to a main printed circuit board (PCB) (control unit) provided inside the document platen unit 14. In this manner, the electric cable is wired without passing near a gear train 9*d*, and is connected to the control unit. Therefore, even if a position of the electric cable is shifted due to a shock and a vibration, the electric cable does not contact the gear train 9*d*.

As illustrated in FIG. 1B, a fine reading window 15 formed of a glass plate for reading a document with the sheet-through scanner using the ADF 3 is formed on the upper surface of the document platen unit 14. A reading surface 16 formed of a glass plate, on which a document to be read with the flatbed scanner is placed, is formed next to the reading window 15. The user places one sheet document or one book document on the reading surface 16. The reading window 15 and the reading surface 16 may be formed of one glass plate. A line sensor positioned at a home position and opposing the reading window 15 is provided underneath the reading window 15. The line sensor is a so-called contact image sensor (CIS), and is a sensor unit composed of a lens array including many light receiving elements and a columnar lens arranged on a line.

Figure 2:
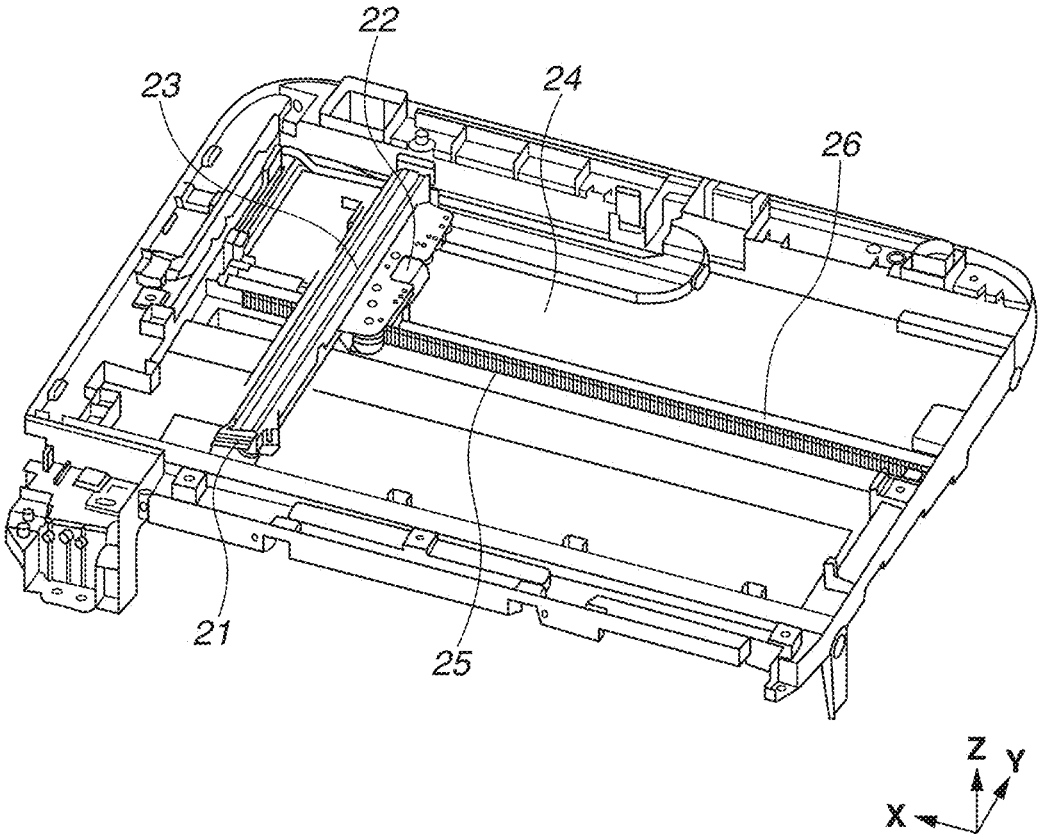
FIG. 2 is a perspective view illustrating a structure of a flatbed scanner.

FIG. 2 is a perspective view illustrating a structure of the flatbed scanner provided under the glass plate forming the reading surface 16. A carriage 21 holds a line sensor unit 23 and moves in the X-direction. The carriage 21 includes a motor 22 serving as a driving source for moving the carriage 21 and a gear train. A rack gear 25 and a guide rail 26 are fixed in the same direction to the base 24 which is the housing of the flatbed scanner. When the motor 22 rotates, a pinion gear, which meshes with the rack gear 25, rotates, and the carriage 21 moves along the guide rail 26. A print unit (recording unit), which prints (records) an image on a sheet (record medium) using an inkjet system, is provided further underneath the flatbed scanner.

Figure 3:
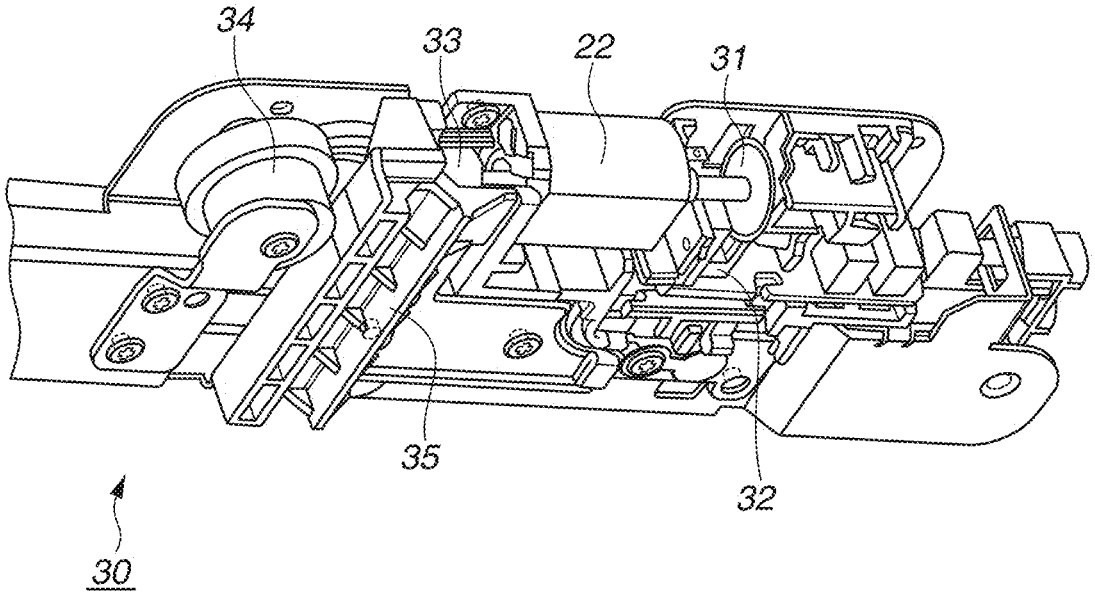
FIG. 3 is a perspective view illustrating a structure of a flatbed scanner driving unit.

FIG. 3 is a perspective view illustrating a structure of a flatbed scanner driving unit 30. A worm gear 33 is attached to one end of a rotating shaft of the motor 22 serving as a direct current (DC) motor, and a code wheel 31 in an encoder unit is attached to the other end thereof. An encoder sensor 32 reads a slit formed in the code wheel 31, and generates a pulse signal. The motor 22 rotates a driving gear 34 via a transmission gear train. The driving gear 34 meshes with the rack gear 25. When a slider attached to the flatbed scanner driving unit 30 slides along the guide rail 26, the carriage 21 moves in the X-direction.

When an operation for reading a document is performed with the flatbed scanner (FBS), the user first opens the ADF 3, places a sheet document or a book document on the reading surface 16, and then closes the ADF 3 to fix the document. While the motor 22 is driven to move the carriage 21 so that the line sensor unit 23 scans and moves, the line sensor unit 23 reads the document.

When an operation for reading a document is performed with the sheet-through scanner, the feeding unit 2 in the ADF 3 feeds documents one by one. The line sensor unit 23, which is at rest at a home position, reads the documents that pass on the reading window 15.

Figure 4:
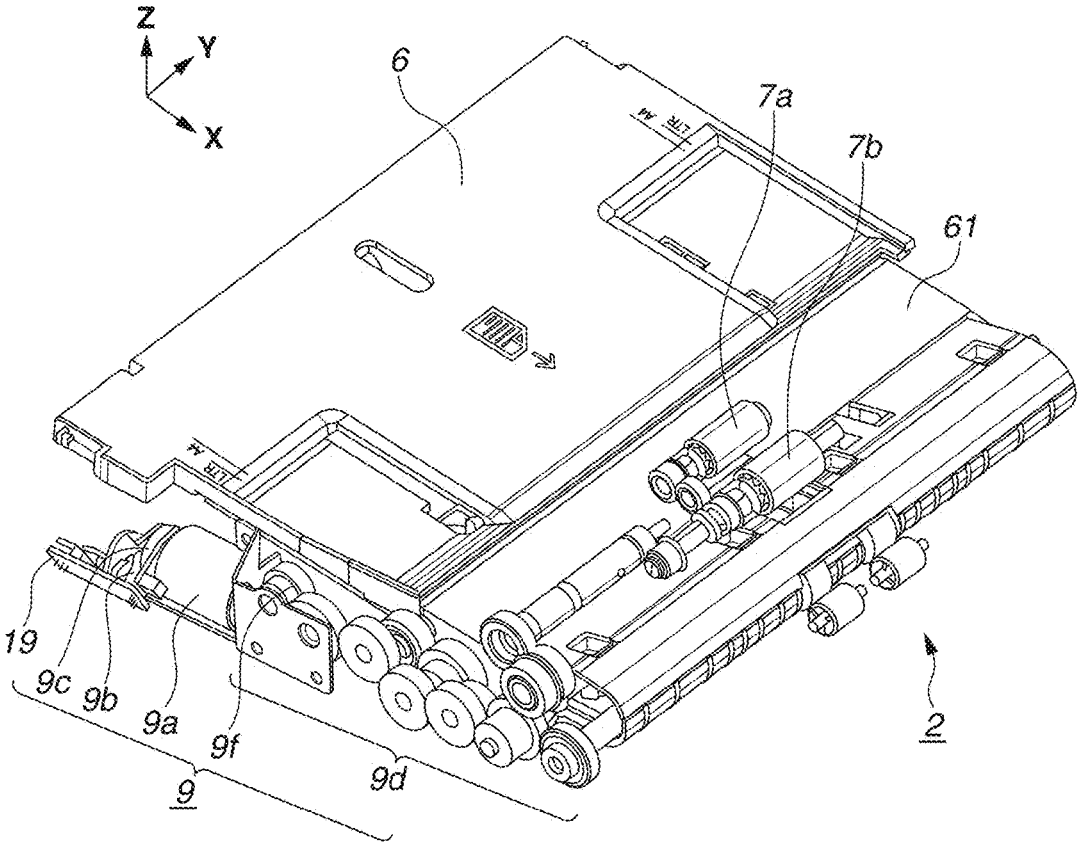
FIG. 4 is a perspective view illustrating a structure of a main driving part of an automatic document feeder (ADF).
Figure 5:
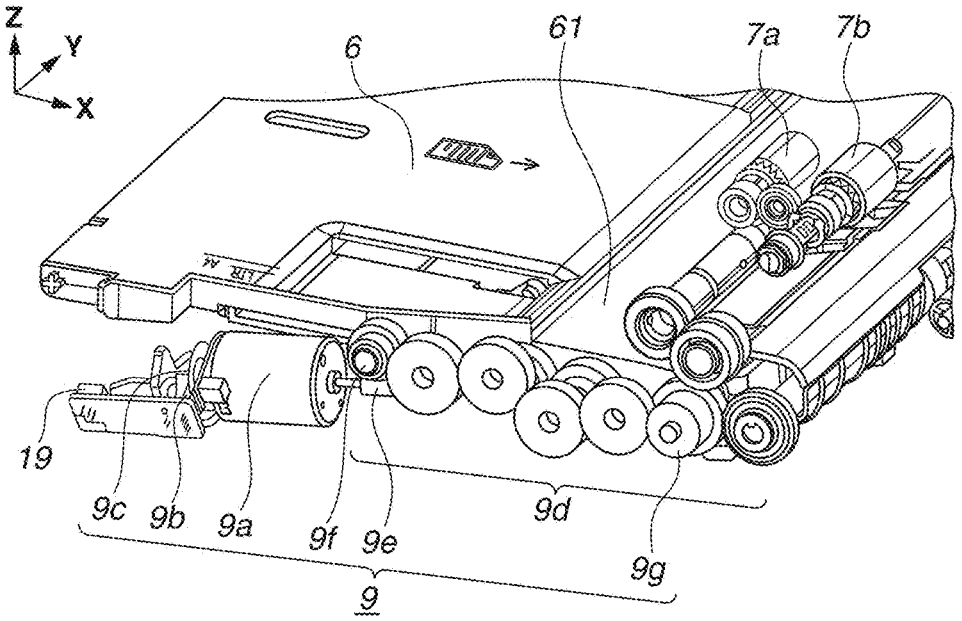
FIG. 5 is a perspective view illustrating a structure of a gear train in the ADF.
Figure 6:
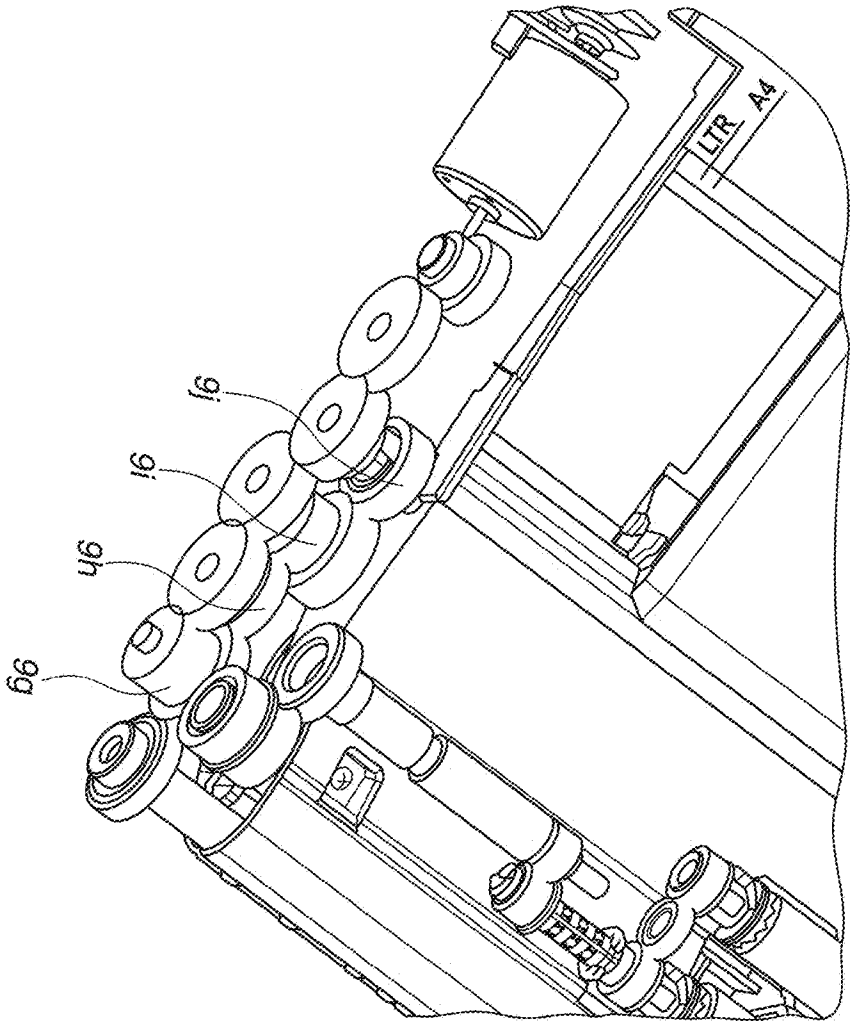
FIG. 6 is a perspective view illustrating the structure of the gear train in the ADF.
Figure 7:
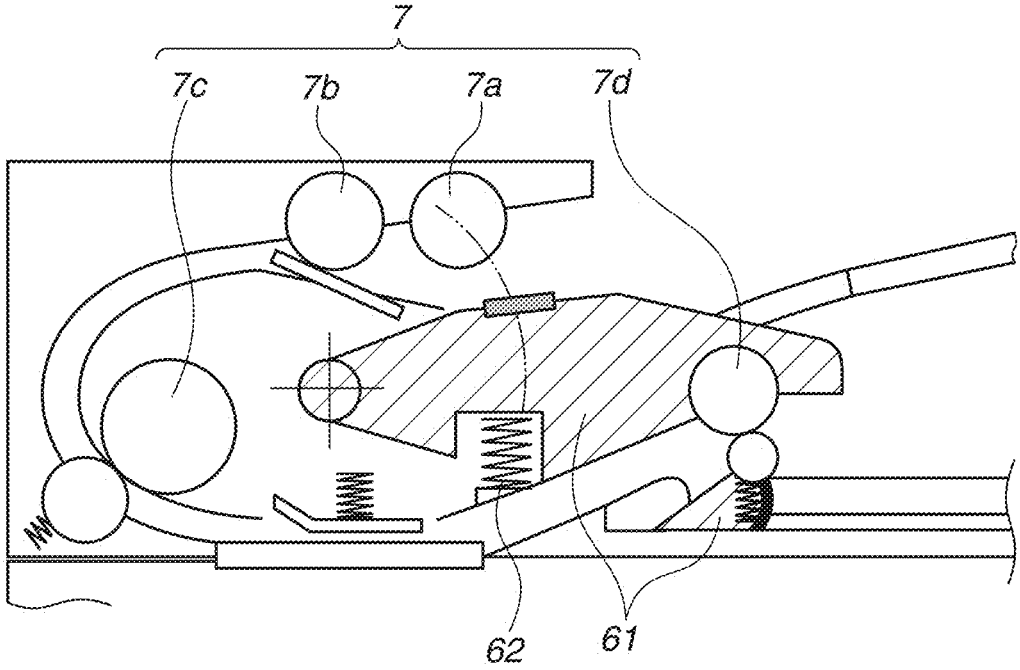
FIG. 7 is a schematic sectional view illustrating a structure of the ADF.

The feeding unit 2 in the ADF 3 will be described below with reference to the drawings. FIG. 4 is a perspective view of a main driving part of the feeding unit 2. FIGS. 5 and 6 illustrate a structure of the gear train 9*d* in the ADF 3. FIG. 7 is a schematic sectional view illustrating a structure of the ADF 3.

The feeding unit 2 which is the main part of the ADF 3 roughly includes a feeding tray 6, a roller group 7 for conveying a document, a motor 9*a*, the transmission gear train 9*d* for transmitting the rotation of a rotating shaft of the motor 9*a* to the roller group 7, and an encoder unit that detects rotation information about the motor 9*a*. The motor 9*a* is a DC motor. The encoder unit includes an encoder sensor 9*b* and a code wheel 9*c*. The driving unit 9 includes the motor 9*a*, the encoder sensor 9*b*, the code wheel 9*c*, and the transmission gear train 9*d*. At least a part of the transmission gear train 9*d*, the motor 9*a*, and the code wheel 9*c* are arranged between the hinges 4*a* and 4*b* provided at two positions in the axial direction (X-direction) of the rotation axis of the hinge 4.

The feeding tray 6 on which a plurality of documents can be stacked is provided in an upper part of the feeding unit 2. The feeding tray 6 is provided with a sensor that detects that the documents are set. A feeding pressure plate 61 is provided at an end of the feeding tray 6 in a document conveyance direction. The feeding pressure plate 61 is rotatably supported to swing with a position on the downstream side of the feeding tray 6 in the document conveyance direction as a rotation center of the feeding pressure plate 61. When a feeding operation is started, a cam member (not illustrated) is unlocked, and a compression spring 62 (an urging unit) applies feeding pressure to the feeding pressure plate 61 (urges the feeding pressure plate 61). Such a configuration enables the height of the feeding pressure plate 61 to change depending on the number of the stacked documents. Details will be described below. After a reading operation is completed, when the reading operation is started again, the feeding pressure plate 61 moves to a position (home position) where the document can be set again by the function of the cam member (not illustrated).

The roller group 7 includes a plurality of rollers for conveying the documents stacked on the feeding tray 6 one by one. A path through which the document is conveyed is folded in a U-turn shape halfway. The roller group 7 mainly includes four rollers, i.e., a pickup roller 7*a* (a feeding roller), a separation roller 7*b*, a conveyance roller 7*c*, and a discharge roller 7*d*. The documents stacked on the feeding tray 6 are pushed up under the feeding pressure by the feeding pressure plate 61, and are pressed against the pickup roller 7*a*. At this time, the documents remains pinched between the pickup roller 7*a* and the feeding pressure roller 61. The pickup roller 7*a* can pick up the uppermost one of the stacked documents by rotating in this state. The separation roller 7*b* can reliably separate, when the plurality of documents has been picked up while being overlaid, the overlaid documents one by one. The conveyance roller 7*c* is provided halfway in the path 8. The conveyance roller 7*c* conveys, even when reading operations of both a surface (first surface) and a rear surface (second surface) of the document are performed, the document toward a position where the line sensor reads the document. The discharge roller 7*d* discharges the document, which has been read, to the discharge tray 12 provided underneath the feeding pressure plate 61.

The discharge roller 7*d* is attached to the bottom of the feeding pressure plate 61. Therefore, an operation of the discharge roller 7*d* is interlocked with the feeding operation of the feeding pressure plate 61. As the feeding operation progresses, the feeding pressure plate 61 rises, and accordingly the discharge roller 7*d* also rises. Details will be described below. A pinch roller (driven roller), which is driven by the discharge roller 7*d*, is also attached to the feeding pressure plate 61, like the discharge roller 7*d*. The pinch roller is driven to rotate by the discharge roller 7*d* at a position opposing the discharge roller 7*d*, to convey the document with the document pinched between the discharge roller 7*d* and the pinch roller. The pinch roller applies a predetermined pinching pressure to the discharge roller 7*d* regardless of a displacement of the discharge roller 7*d*. In the present exemplary embodiment, the pinch roller, which is driven by the discharge roller 7*d*, is attached to the feeding pressure plate 61, like in the discharge roller 7*d*, to keep the pinching pressure applied to the discharge roller 7*d* constant. However, the present invention is not limited to this. The pinch roller may be held in another frame to follow the rise of the discharge roller 7*d* while ensuring the pinching pressure required to pinch and convey the document.

The motor 9*a* serving as a driving source and the transmission gear train 9*d* for decelerating the rotation of the motor 9*a* and transmitting the decelerated rotation to each of the rollers of the roller group 7 are arranged on the side (back side) of the hinge 4 in the feeding unit 2. The motor 9*a* has a body in a cylindrical vertically long shape in which the length in the axial direction (X-direction) of the rotating shaft (output shaft) is larger than that in a radial direction (a Y-axis direction and a Z-direction). The rotating shaft of the motor 9*a* protrudes longways with respect to the body of the motor 9*a* on both sides (head and tail sides) of the rotating shaft. The rotating shaft of the motor 9*a* is substantially parallel to the respective rotation axes of the hinges 4*a* and 4*b*. A rotation axis of each of the rollers constituting the roller group 7 is arranged so that an axial direction of the rotating shaft is the Y-direction. The direction is perpendicular to the axial direction of the rotating shaft of the motor 9*a*. The rotation axis of each of the rollers and the rotating shaft of the motor 9*a* may not necessarily perpendicular to each other.

A worm gear 9*e*, which is a part of the transmission gear train 9*d*, is attached to an end on the head side (referred to as a first end) of the rotating shaft of the motor 9*a* on the side of the transmission gear train 9*d*. The transmission gear train 9*d* includes a plurality of gears including a gear 9*f* that meshes with the worm gear 9*e*. The rotation of the motor 9*a* is transmitted to each of the gears in the transmission gear train 9*d* via the worm gear 9*e*. The transmission gear train 9*d* includes gears respectively attached to ends of the rotation axes of the pickup roller 7*a*, the separation roller 7*b*, the conveyance roller 7*c*, and the discharge roller 7*d*, and a plurality of idler gears for driving transmission among those gears. When viewed from above (in the Z-direction), the transmission gear train 9*d* is arranged substantially along a direction in which the rotating shaft of the motor 9*a* extends. When viewed from the side (in the Y-direction), the gear train 9*d* is also arranged substantially along the direction in which the rotating shaft of the motor 9*a* extends. The rotating shaft of the motor 9*a* may have an inclination to a direction in which the gear train 9*d* is formed.

To transmit a driving force to the discharge roller 7*d*, a gear 9*g* is arranged at a rotation center around which the feeding pressure plate 61 swings. The driving force is transmitted to a gear 9*j* attached to an end of the discharge roller 7*d* via gears 9*h* and 9*j* from the gear 9*g*, to rotate the discharge roller 7*d*. The discharge roller 7*d* is attached to the bottom of the feeding pressure plate 61. Even when the discharge roller 7*d*, together with the feeding pressure plate 61, swings, therefore, the driving force can be accurately transmitted to the discharge roller 7*d* without being accompanied by a change between gear shafts. While the driving force is transmitted by the gears from the rotation center of the feeding pressure plate 61 to the discharge roller 7*d* in the present exemplary embodiment, the present invention is not limited to this. The driving force may be transmitted using a belt and a pulley in combination.

While the feeding pressure plate 61 has the rotation center and swings in the present exemplary embodiment, the feeding pressure plate 61 may move up and down in a normal direction of a document stacking surface. In the case, when the gear 9*h* includes a pendulum gear, the change between the gear shafts can be coped with. If the driving force is transmitted using the belt, the change between the gear shafts can be coped with by arranging a tensioner at an intermediate point of the belt.

On the other hand, the code wheel 9*c* in the encoder unit for detecting a rotational state (an amount of rotation and a rotation speed) of the motor 9*a* is attached to an end on the tail side (referred to as a second end) of the rotating shaft of the motor 9*a* on the opposite side of the side of the worm gear 9*e*. Further, the code wheel 9*c* is provided with an encoder sensor 9*b* having a photointerrupter for optically detecting a slit pattern formed in a cylindrical shape.

Thus, the worm gear 9*e* constituting a part of the transmission gear train 9*d* is attached to the end (first end) of the rotating shaft of the motor 9*a*, and the code wheel 9*c* is attached to the other end (second end) of the rotating shaft of the motor 9*a*. The encoder sensor 9*b* is also arranged at the second end. Thus, the code wheel 9*c*, the motor 9*a*, and the gears constituting the transmission gear train 9*d* substantially line up. When the code wheel 9*c*, the motor 9*a*, and the gears are thus arranged, a space is effectively used, to miniaturize the apparatus.

As the motor 9*a* rotates, the code wheel 9*c* arranged coaxially with the rotating shaft of the motor 9*a* also rotates. The encoder sensor 9*b* outputs a pulse signal as the slit pattern formed in the code wheel 9*c* passes therethrough. When the number of pulses is counted, the rotational state (the amount of rotation and the rotation speed) of the motor 9*a* can be detected. The control unit controls the rotation of the motor 9*a* so that document feeding is performed at a predetermined speed or by a predetermined amount in response to a detection result.

Figure 8:
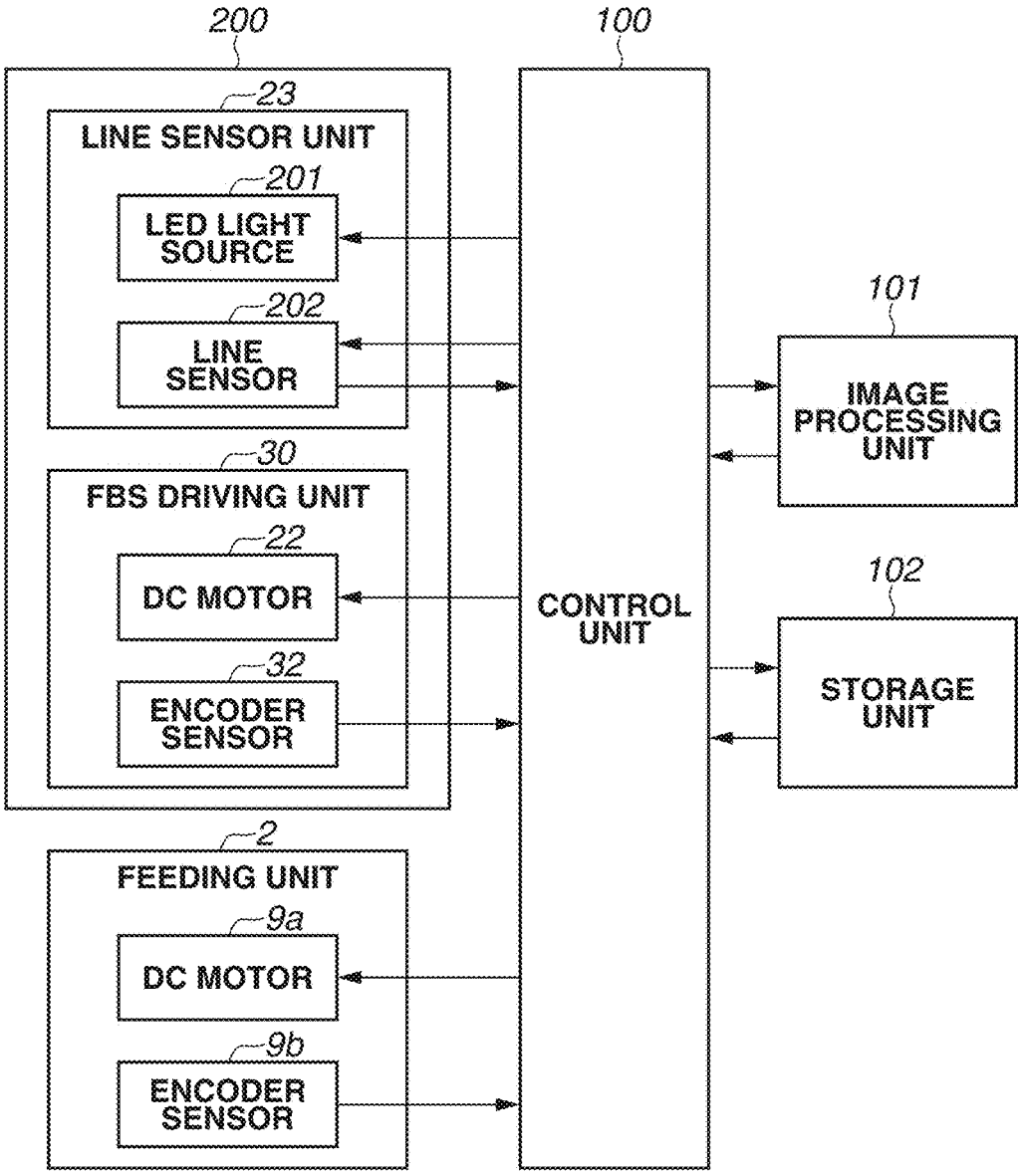
FIG. 8 is a block diagram illustrating a system configuration centered on a control unit.

FIG. 8 is a block diagram illustrating a system configuration centered on a control unit 100. The control unit 100 includes a central processing unit (CPU), and performs various type of control such as reading control. An image processing unit 101 dedicated to image processing, a storage unit 102, and elements constituting the line sensor unit 23, the FBS driving unit 30, and the feeding unit 2 are connected to the control unit 100. Each of a light emitting diode (LED) light source 201 and a line sensor 202 included in the line sensor unit 23 are connected to the control unit 100. Each of a DC motor 22 and an encoder sensor 32 included in the FBS driving unit 30 is also connected to the control unit 100. Each of a motor 9*a* and an encoder sensor 9*b* included in the feeding unit 2 is also connected to the control unit 100.

In the document reading apparatus configured as described above, the document is read in a pixel unit. The "pixel" is a virtual pixel obtained by dividing a longitudinal direction of a document surface (a movement direction of the document) and a transverse direction thereof (a direction in which elements included in the line sensor 202 are arranged) into pixels at a predetermined pitch. The size of one pixel in the transverse direction matches the size of one of the elements included in the line sensor 202. The size of one pixel in the longitudinal direction is determined by a speed at which the document is moved and a timing at which the document is read by the line sensor 202. If reading resolution is 600 dpi, for example, one pixel has a length of 1/600 inches.

In the document reading apparatus according to the exemplary embodiment of the present invention, an operation performed when a document is read with the sheet-through scanner using the ADF 3.

The user first sets one document or a plurality of documents on the feeding tray 6, and presses a scan start button provided on the operation panel 13. The control unit performs control to rotate the motor 9*a* when the sensor detects that the document is set in the feeding tray 6. As the motor 9*a* rotates, the gears included in the transmission gear train 9*d*, i.e., the worm gear 9*e* to the gear 9*f* and the subsequent gear train rotate. Thus, the pickup roller 7*a*, the separation roller 7*b*, the conveyance roller 7*c*, and the discharge roller 7*d* constituting the roller group 7 concurrently rotate.

Then, the feeding pressure plate 61 rises, and the uppermost document is pressed against the pickup roller 7*a*. The document remains pinched between the pickup roller 7*a* and the feeding pickup roller 61. In the state, the pickup roller 7*a* rotates. Therefore, the uppermost document is pickup up. The documents picked up are reliably separated one by one with a frictional force between the separation roller 7*b* and a separation pad opposing the separation roller 7*b*. The conveyance roller 7*c* conveys the documents along the path 8 at a predetermined speed. The document is scanned by the line sensor unit 23 while being conveyed at a predetermined speed with a reading surface (first surface) of the document directed toward the reading window 15, and is read. The discharge roller 7*d* discharges the read document onto the discharge tray 12.

A configuration in which as the number of documents pinched between the pickup roller 7*a* and the feeding pressure plate 61 decreases, the discharge roller 7*d* moves in a height direction and a discharge space (the number of documents that can be stacked) on the discharge tray 12 increases, which characterizes the present invention, will be specifically described.

Figure 9A:
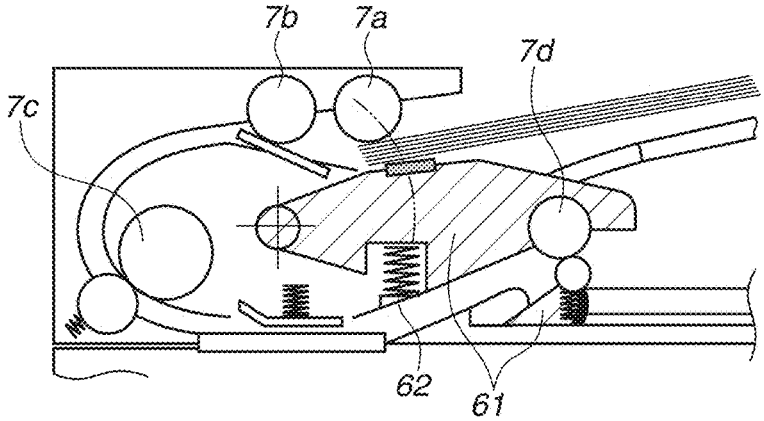
FIGS. 9A, 9B, and 9C are respectively schematic sectional views illustrating how documents are fed and discharged according to the exemplary embodiment of the present invention.
Figure 9B:
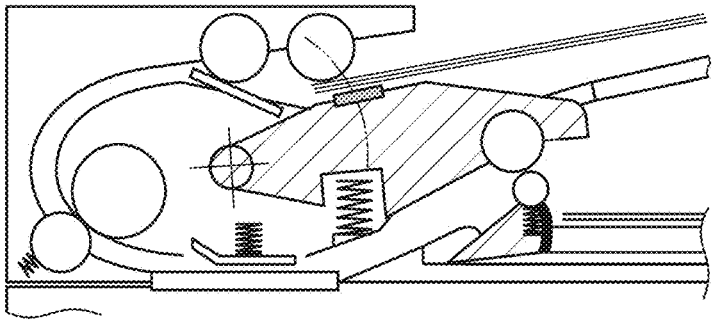
Figure 9C:
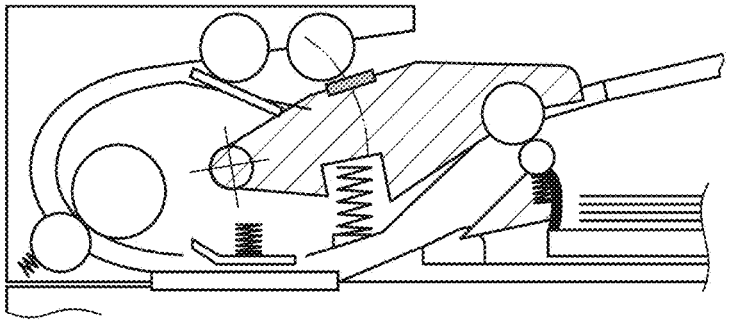

FIGS. 9A, 9B, and 9C are schematic sectional views illustrating how documents are fed and discharged according to the exemplary embodiment of the present invention. When a plurality of documents is set, and a reading operation is started, the uppermost document is pressed against the pickup roller 7*a*, and is fed, as illustrated in FIG. 9A. At this time, a compression spring 62 applies feeding pressure serving as a force for pushing up the feeding pressure plate 61. Thus, the discharge roller 7*d* rises, when the documents are set, by a gap between the documents and the pickup roller 7*a*. If a maximum number of documents that can be stacked are set, an amount of rise of the discharge roller 7*d* is only an amount required to apply the feeding pressure. At this time, a discharge space remains minimum.

When the document feeding progresses, the feeding pressure plate 61 rises, as illustrated in FIG. 9B, and the discharge roller 7*d* attached to the feeding pressure plate also rises by the same amount, and accordingly a discharge space increases. Therefore, the documents can be continuously discharged onto the discharge tray 12 without being jammed because there is no discharge space halfway.

When a reading operation for all the documents is completed, the feeding pressure plate 61 finally rises to a maximum extent, to remain pressed against the pickup roller 7*a*, as illustrated in FIG. 9C. Similarly, the discharge roller 7*d* also rises to a maximum extent so that the discharge space remains maximum. Thus, a position of the discharge roller 7*d* moves depending on the number of the documents pinched between the pickup roller 7*a* and the feeding pickup roller 61. Therefore, all the documents can be finally discharged and stacked on the discharge tray 12 without being jammed halfway.

As described above, according to the present invention, there can be provided a reading apparatus and a recording apparatus the respective heights of which can be reduced without reducing the number of documents that can be fed, with a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-044057, filed Mar. 5, 2015, which is hereby incorporated by reference herein in its entirety.

What is claimed is:

1. A reading apparatus comprising:

a feeding tray on which a plurality of documents are stacked;

a feeding roller configured to feed a document stacked on the feeding tray;

a feeding pressure plate rotatably and swingable supported with a position on a downstream side of the feeding tray in a document conveyance direction as a rotation center of the feeding pressure plate, and configured to pinch the plurality of documents with the feeding roller;

an urging unit configured to urge the feeding pressure plate so as to cause the feeding pressure plate to move toward the feeding roller when the number of the documents decreases;

a reading unit configured to read an image on a document fed by the feeding roller;

a discharge roller provided rotatably to the feeding pressure plate and discharges the document on which image read by the reading unit to underneath the feeding pressure plate;

a driving source configured to drive the discharge roller; and a rotating member provided coaxially with the rotation center of the feeding pressure plate and configured to transmit a driving force from the driving source to the discharge roller.

2. The reading apparatus according to claim 1, further comprising a discharge tray, on which the document discharged by the discharge roller is stacked, underneath the feeding pressure plate.

3. The reading apparatus according to claim 1, further comprising a driven roller, which rotates while being driven by the discharge roller, for pinching the document between the discharge roller and the driven roller.

4. A recording apparatus comprising:

the reading apparatus according to claim 1; and a recording unit configured to record an image of a document read by the reading apparatus on a recording medium.

5. The reading apparatus according to claim 1, wherein the driving source is a motor.

6. The reading apparatus according to claim 1, wherein the rotating member is a gear.

7. The reading apparatus according to claim 1, wherein the feeding roller is driven by the driving source.

8. The reading apparatus according to claim 1, further comprising a conveyance roller configured to convey the document fed by the feeding roller to a position where the image on the document is to be read by the reading unit.

9. The reading apparatus according to claim 8, wherein the conveyance roller is driven by the driving source.

* * * * *